US006629325B2

(12) United States Patent
Heavrin

(10) Patent No.: US 6,629,325 B2
(45) Date of Patent: Oct. 7, 2003

(54) ENABLER COVER FOR ROTATABLE HAND GRIP

(76) Inventor: Thomas Heavrin, 501 Mountain Ash, Arlington, OH (US) 45814

( * ) Notice: Subject to any disclaimer, the term of this patent is extended or adjusted under 35 U.S.C. 154(b) by 0 days.

(21) Appl. No.: 10/007,932

(22) Filed: Dec. 7, 2001

(65) Prior Publication Data

US 2002/0073488 A1 Jun. 20, 2002

Related U.S. Application Data

(60) Provisional application No. 60/257,084, filed on Dec. 20, 2000.

(51) Int. Cl.[7] ..... A47C 31/00; A47C 21/08

(52) U.S. Cl. ..... 5/662; 5/663

(58) Field of Search ..... 5/663, 662, 658, 5/992

(56) References Cited

U.S. PATENT DOCUMENTS

| | | | | | |
|---|---|---|---|---|---|
| 4,215,446 | A | * | 8/1980 | Mahoney | 5/663 |
| 4,370,765 | A | * | 2/1983 | Webber | 5/663 |
| 4,970,744 | A | * | 11/1990 | Davis | 5/496 |
| 5,035,014 | A | | 7/1991 | Blanchard | |
| 5,044,025 | A | | 9/1991 | Hunsinger et al. | |
| 5,060,327 | A | * | 10/1991 | Celestina et al. | 5/662 |
| 5,187,824 | A | | 2/1993 | Stryker | |
| 5,384,927 | A | * | 1/1995 | Mardero et al. | 5/662 |
| 5,481,772 | A | | 1/1996 | Glynn et al. | |
| 5,566,407 | A | * | 10/1996 | Lien | 5/663 |
| 5,642,545 | A | * | 7/1997 | Howard | 5/663 |
| 5,689,839 | A | | 11/1997 | Lagani'ere et al. | |
| 5,787,530 | A | * | 8/1998 | Brix | 5/662 |
| 5,864,900 | A | | 2/1999 | Landau | |
| 5,867,853 | A | | 2/1999 | Feld | |
| 5,890,244 | A | | 4/1999 | Cartwright et al. | |
| 5,898,964 | A | * | 5/1999 | Stanley | 5/663 |
| 5,987,666 | A | | 11/1999 | Zigmont | |
| 6,038,721 | A | * | 3/2000 | Gordon | 5/663 |
| 6,401,281 | B1 | * | 6/2002 | Younge | 5/663 |

* cited by examiner

*Primary Examiner*—Alexander Grosz
(74) *Attorney, Agent, or Firm*—Emch, Schaffer, Schaub & Porcello Co., L.P.A.

(57) ABSTRACT

This enabler cover for use with hand rails on a bed comprises a pad which fits around the rails of the hand rails. The pad, including a cover material, defines an interior space formed of the material. The material is flexible, non-abrasive and substantially resistant to penetration by an appendage of a person. The pad also includes a foam material filling the interior space defined by the cover material. Further, the cover material includes a means for enabling the enabler cover to fit around the rails of the hand rails. A mesh cover then covers any opening in the hand rails.

18 Claims, 2 Drawing Sheets

ENABLER COVER FOR ROTATABLE HAND GRIP

This application claims the benefit of U.S. provisional application Ser. No. 60/257,084, filed Dec. 20, 2000.

TECHNICAL FIELD

This invention relates to enabler covers for hospital or nursing home bed rails.

BACKGROUND OF THE INVENTION

Hospital beds traditionally had some type of collapsible side rail on each side of the mattress, so that a patient on the bed cannot inadvertently roll off of the bed and receive serious injuries from a fall to the floor. Padded covers, bumper wedges and the like also are used with the bed-rails to improve the comfort and safety of patients in long-term care facilities.

One recent development is a padded gap protector that provides zero clearance no matter what the articulated position of the bed is. The pad remains in compression with the mattress and closes the gap between the mattress and side rails. The pad provides a zero gap when the mattress is in a horizontal position and when the mattress is secured in an articulate position such as an elevated position. The gapless bed rail pads are described in U.S. patent applications Ser. No. 60/198,591 filed Apr. 19, 2000, and Ser. No. 09/809,881 filed Mar. 16, 2001 both of which are herein incorporated by reference. This application issued as U.S. Pat. No. 6,347,422 on Feb. 19, 2002.

Another need exists for hand rails used with hospital and nursing home beds. The industry often refers to these hand rails as grab bars, positioning bars and the like.

The hand rails prevent, to some extent, a resident from falling out of bed. Internal bed positioning or assistance into and out of bed is the major use. Hand rails typically have a tubular frame which mounts to the bed frame. The hand rails may rotate up to 360° and lock into a number of positions. The hand rails, however, have an open center with the tubular frame circumscribing the opening. During operation or in a stationary position, a limb or other body part should not extend through the opening. As a result, a need remains for improving these hand rails.

BRIEF SUMMARY OF THE INVENTION

This enabler cover for use with hand rails on a bed comprises a pad which fits around the rails of the hand rails. The pad, including a cover material, defines an interior space formed of the material. The material is flexible, non-abrasive and substantially resistant to penetration by an appendage of a person. The pad also includes a foam material filling the interior space defined by the cover material. Further, the cover material includes a means for enabling the enabler cover to fit around the rails of the hand rails. A mesh cover then covers any opening in the hand rails.

DETAILED DESCRIPTION OF THE INVENTION

Figure 1:
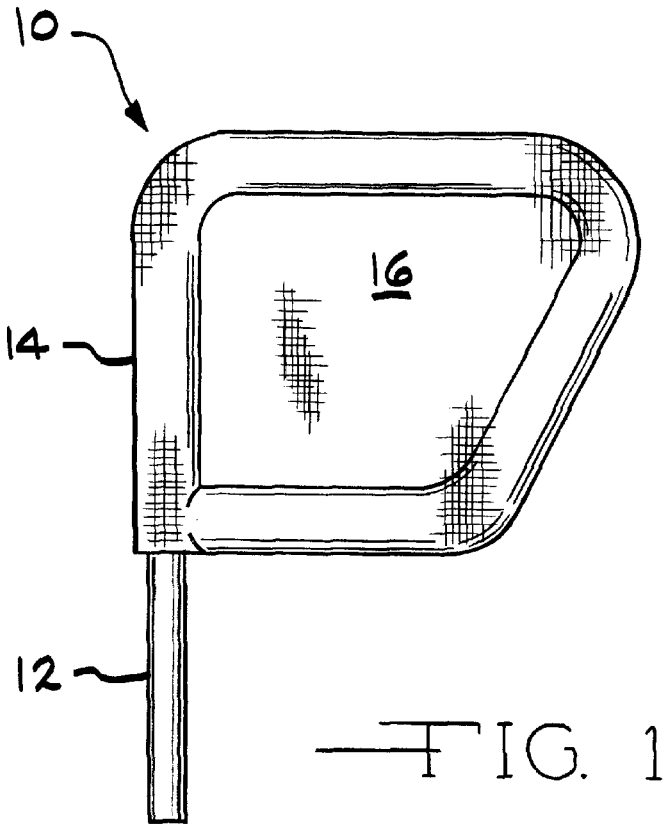
FIG. 1 shows the patient side of a first embodiment of an enabler cover according to this invention.

FIG. 1 shows enabler cover 10. Cover 10 secures to hand rails 12 of a long term care bed (not shown). Cover 10 includes tubular pad 14 and mesh cover 16. In this preferred embodiment, mesh cover 16 encloses or encapsulates tubular pad 14 and hand rail 12. FIG. 1 shows the patient side of cover 10. Any fasteners preferably are on the outside of rail 12 away from the occupant of the bed.

Figure 2:
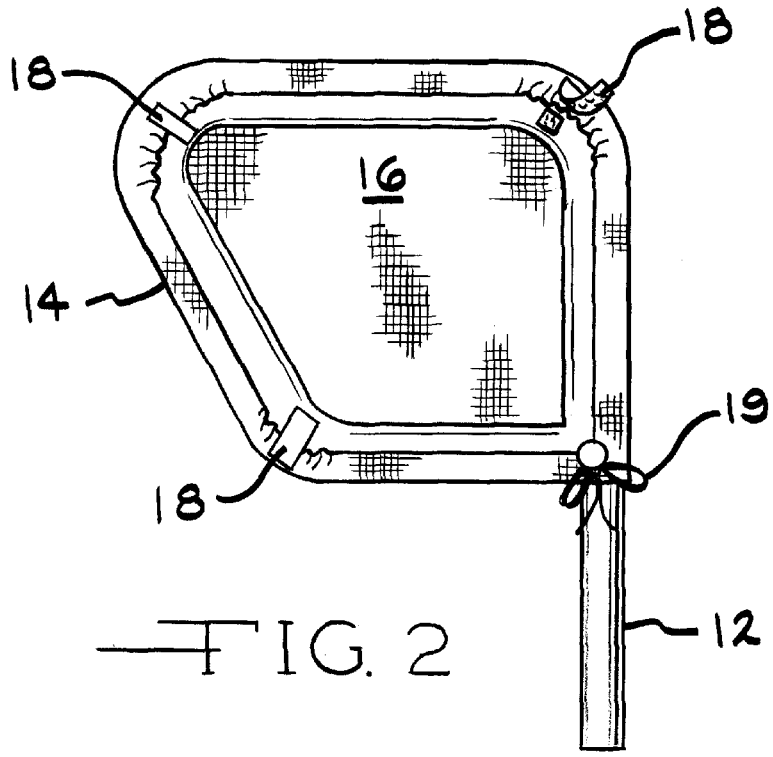
FIG. 2 shows the opposite side of the first embodiment.

FIG. 2 shows the outside of cover 10 away from the bed. Fastener 18 secures mesh cover to pad 14 and rail 12. Fastener 18 preferably is an adhesive strip or Velcro® strip. Fastener 19 is a draw string for securing pad 14 to rail 12 which is another preferred embodiment.

Figure 3:
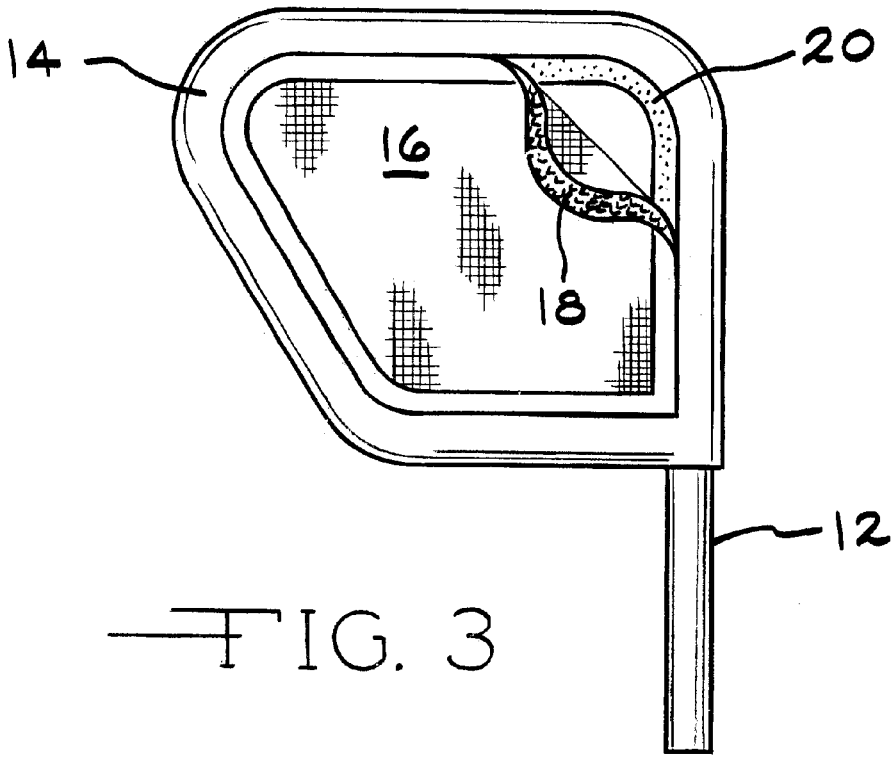
FIG. 3 shows a second embodiment of an enabler cover according to this invention.

FIG. 3 shows another preferred embodiment wherein mesh cover 16 does not encapsulate tubular pad 14. In this embodiment, mesh cover 16 attaches to inside edge 20 of pad 14. Again, fastener 18 secures mesh cover 16 to tubular pad 14. Fastener 22 secures tubular pad 14 to hand rail 12.

Figure 4:
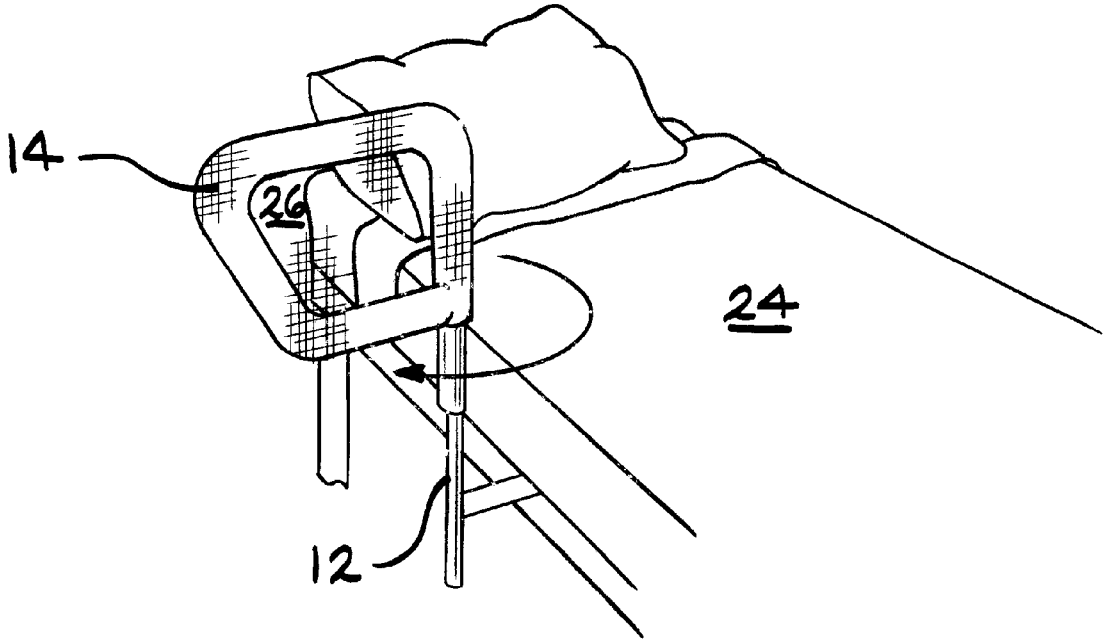
FIG. 4 shows a hand rail, bed, and an enabler cover.

FIG. 4 shows hand rail 12 on long term care bed 24. Hand rail 12 forms annular space 26. Mesh cover 16 covers annular space 26. Fastener 18, 19 and fastener 22 are on the outside of rail 12 away from the occupant of bed 24.

The pad of this invention uses a foam which may vary widely. Preferably, the foam is a polyurethane foam. The polyurethane likewise varies widely. Generally, it is a thermoplastic polymer produced by the condensation reaction of a polyisocyanate and a hydroxyl-containing material, e.g., a polyol derived from propylene oxide or trichlorobutylene oxide. The basic polymer unit is formed as follows: $R_1NHCOOR_2$.

A preferred foam is RUBATEX ⅜" wall: fire rated (ASTM E-84 ME; 25 flame or less; 50 smoke or less). The foam generally has a density ranging from 0.25 to 2.0 lbs/ft$^3$.

The cover of the enabler may vary widely. Generally, the cover is made of a vinyl material. The covers preferably are based on homopolymers or copolymers of vinyl chloride, for example vinyl chloride/vinyl acetate copolymers. The homopolymers and the copolymers are both commonly referred to as PVC resins or PVC polymers.

Preferably, the covers are flame-resistant and have a low-smoke value. This usually is accomplished by incorporating a metallic salt such as aluminum trihydrate. Typically, the materials should have a flame spread of 25 or less and a smoke value of less than 400 according to standard ASTM tests.

Preferably, the pad is a tubular pad and the means enabling the enabler cover to fit around the rails is an elongated slit. A means for securing the elongated slit preferably is an adhesive. Usually, the elongated slit has edges and the adhesive is on the edges.

FIG. 1 shows the inside left side enabler cover. This side facing the occupant of the bed is smooth with no securing means facing the bed. The hand rails typically are one inch tubular shell.

FIG. 2 shows the outside of the left side enabler cover. Adhesive pads secure the comers of the vinyl mesh cover to the pad. A drawstring pulls the vinyl mesh cover to the pad.

The enabler cover also may include a release paper covering the adhesive and a draw string to secure the pad to the hand rails.

FIG. 3 shows hand rails where a portion of the rails form an annular space therebetween. The mesh cover will cover the annular space.

The mesh covering the opening of the hand rails are made of the same vinyl material. An adhesive also secures the mesh cover to the pad.

The enabler cover seals away from the bed side of the cover. This is true for the elongated adhesive strips, adhesive pads on the mesh outer cover and the nylon string ties.

The enabler cover is made as a right side and left side pair. The mesh covers are not interchangeable. The best protection for the individual in the bed is to install the mesh cover facing inward. There is no need to replace the tubular foam padding for right or left side us of a particular bed rail.

To install, place the tubular foam padding around the upper portion of the rail. The elongated split in the foam padding should face inward. Remove the protective adhesive strips from the tubular foam padding. Close the foam padding by attaching the adhesive edges. Then place the mesh cover over the rail, with the circular adhesive patch next to the post side. Next, draw the nylon string tight and tie into the final position. Tuck the tied bow inside of the mesh cover. The last step is to adhere the adhesive circular patch as the final step.

For cleaning, remove the mesh cover from the rail for thorough cleaning of the cover and padding. A damp cloth or a mild bristle brush should be used. A mild detergent is recommended for prolong color and strength of this product.

The adhesive I use may vary widely. Typically, they are contact adhesives designed for a soft seam bond. Rubatex contact adhesive is one such adhesive. It is neoprene based and excellent for bonding rubber, PVC, NBR and other vinyl and rubber like products together. Urethane adhesives as well as pressure sensitive acrylic adhesives also may be used.

The following example further illustrate this invention:

EXAMPLE I

The enabler cover comprises a tubular foam padding which fits around the upper portion of the hand rail. An elongated split in the foam padding preferably face outwardly away from the bed. The elongated split includes adhesive strips protected with release paper. To secure the cover, remove the protective release paper from the tubular foam padding. Close the foam padding by attaching the adhesive edges to each other. A nylon mesh cover protects the opening in the hand rails. To install, place the mesh cover over the hard rail with the circular adhesive pad next to the post side. A draw string also is included. Draw the nylon draw string tight and tie into the final position. Next, tuck the tied bow inside of the mesh cover. Adhere the adhesive circular mesh pad as the final step.

EXAMPLE II

A preferred hand rail is the Arcorail System. See FIG. 4. This hand rail rotates 360° and locks firmly and safely in four positions. To rotate the hand rail, grip it close to where the center and top rails meet. Pull up lightly and turn it in either direction to a desired 90° position. To lock the hand rail, lower it. You will feel it drop slightly into the 90° position. Push the hand rail from side to side to ensure that it will not move out of position. To exit and enter the bed, rotate hand rail and lock it perpendicular at a right angle to the mattress. Sit down on the opposite side of the hand rail furthest from your pillow. To sit up or to reposition while in bed, grasp the hand rail by the center rail.

In addition to these embodiments, persons skilled in the art can see that numerous modifications and changes may be made to the above invention without departing from the intended spirit and scope thereof.

I claim:

1. A cover for use with rotatable hand grip rails on a bed comprising:

an arrangement of rails forming the hand grip rails;

a tubular pad which fits around the rails of the hand grip rails;

the pad including a cover material defining an interior space formed of a material, the material being flexible, non-abrasive and substantially resistant to penetration by an appendage of a person;

the pad also including a foam material filling the interior space defined by the cover material;

the cover material including a means enabling the cover to fit around the rails of the hand rail;

a mesh cover covering an opening in the hand rails.

2. A cover according to claim 1 wherein means enabling the cover to fit around the rails is an elongated slit.

3. A cover according to claim 2 including a means for securing the elongated slit.

4. A cover according to claim 3 wherein the means for securing the elongated slit is an adhesive.

5. A cover according to claim 4 wherein the elongated slit has edges and the adhesive thereon.

6. A cover according to claim 4 including release paper covering the adhesive.

7. A cover according to claim 1 wherein the cover material is a vinyl.

8. A cover according to claim 1 wherein the foam is a urethane foam.

9. A cover according to claim 1 wherein the foam has a density ranging from 0.25 to 2.0 lbs/ft$^3$.

10. A cover according to claim 1 wherein the mesh cover is a vinyl mesh.

11. A cover according to claim 1 wherein an adhesive secures the mesh cover to the pad.

12. A cover according to claim 1 wherein the tubular pad circumscribes an annular space, the mesh cover covers the annular space, and including a draw string attached to the tubular pad to secure the tubular pad to the rotable hand grip rails.

13. A cover according to claim 12 wherein the mesh cover encloses the tubular pad and the annular space.

14. A cover according to claim 1 wherein the mesh cover is nylon mesh.

15. A cover according to claim 1 wherein the rotatable hand grip rails are adapted to rotate 360°.

16. A cover according to claim 1 wherein the rotatable hand grip rails are adapted to firmly lock in position.

17. A cover according to claim 16 wherein the rotatable hand grip rails lock in four positions.

18. A cover according to claim 17 wherein the four positions are spaced apart 90°.

* * * * *